US006905373B2

(12) United States Patent
Wu

(10) Patent No.: US 6,905,373 B2
(45) Date of Patent: Jun. 14, 2005

(54) ELECTRICAL CONTACT FOR CABLE ASSEMBLY

(75) Inventor: Jerry Wu, Irivine, CA (US)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 10/617,575

(22) Filed: Jul. 11, 2003

(65) Prior Publication Data

US 2005/0009411 A1 Jan. 13, 2005

(51) Int. Cl.[7] ..... H01R 13/432
(52) U.S. Cl. ..... 439/746; 439/872
(58) Field of Search ..... 439/746–749, 439/752.5, 871–872, 851–857, 861, 595, 439/382, 891

(56) References Cited

U.S. PATENT DOCUMENTS 3,964,815 A 6/1976 McDonough
5,102,354 A 4/1992 Crane et al.
5,295,871 A * 3/1994 Lapraik et al. ..... 439/746
5,362,260 A * 11/1994 Peloza ..... 439/746
5,664,326 A * 9/1997 Ohsumi ..... 29/874
5,681,190 A * 10/1997 Childs ..... 439/856
5,993,268 A * 11/1999 Yamaguchi ..... 439/752.5
6,375,501 B1 * 4/2002 Kojima ..... 439/595

* cited by examiner

*Primary Examiner*—Gary Paumen
*Assistant Examiner*—Edwin A. Leon
(74) *Attorney, Agent, or Firm*—Wei Te Chung

(57) ABSTRACT

A cable assembly (1) includes an insulating housing (4) receiving a number of contacts (5) therein and a number of cables (3) terminated to corresponding contacts. Each contact includes an intermediate portion (50), a central contact beam (52) extending upwardly from a front end (500) of the intermediate portion, a pair of side contact beams (54) extending upwardly from two opposite sides of the intermediate portion and a tail portion (56) extending from a rear end of the intermediate portion. The side contact beams include a pair of vertical arms (540) located at opposite sides of the central contact beam and a pair of resilient side arms (542) extending rearwardly from the vertical arms. The resilient side arms have connecting portions **(54*a*)** extending toward each other.

4 Claims, 11 Drawing Sheets

ELECTRICAL CONTACT FOR CABLE ASSEMBLY

CROSS-REFERENCE TO RELATED APPLICATIONS

Relevant subject matter is disclosed in co-pending application entitled "CABLE ASSEMBLY HAVING POWER CONTACTS" which is invented by the same inventor as this patent application and assigned to the same assignee with this application.

BACKGROUND OF THE INVENTION

1. Field of the Invention

The present invention relates to a cable assembly, and particularly to a cable assembly having improved contacts for ensuring a reliable connection with complementary contacts.

2. Description of Related Art

Electrical connectors are widely used in electronic systems for establishing an electrical connection between two electronic devices thereof. Some electronic devices, such as servers, are equipped with power connectors for carrying power. These power connectors generally comprise two mating halves, i.e., a plug connector connecting with a circuit substrate and a receptacle cable assembly connecting with a power supply system for supplying power to the circuit substrate. The receptacle cable assembly generally comprises a unitarily molded insulating housing, a plurality of socket-type power contacts retained in the housing, and a plurality of cables terminated to corresponding power contacts. Such a socket-type power contact can be referred to U.S. Pat. No. 3,964,815. Once the socket-type contacts engage with corresponding pin-type contacts of the plug connector, a mechanical and electrical connection is established between the plug connector and the receptacle cable assembly. However, in some particular circumstances where high shock or vibration exists, the connection of the plug contact and the receptacle contact is easy to become loose. This results in an unreliable electrical connection between the plug connector and the receptacle cable assembly.

U.S. Pat. No. 5,102,354, issued to Crane et al., discloses a receptacle cable assembly having receptacle contacts to solve the above-mentioned problem. Each receptacle contact includes a front contact portion, a rear cable gripping portion and an intermediate portion interconnecting the contact portion with the gripping portion. The contact portion has a central contact beam extending upwardly and rearwardly from a front end of the intermediate portion to form a curved contact section above the intermediate portion, and a pair of side contact beams integrally and upwardly extending from two opposite sides of the central contact beam. When the receptacle cable assembly engages with a complementary plug connector, a plug contact of the complementary plug connector electrically contacts with the side contact beams and the curved contact section of the central contact beam to achieve multiple contact points therebetween. However, since the side contact beams integrally extend from the central contact beam, the side contact beams would move downward with the resiliently downward deformation of the central contact beam during the insertion of the plug contact, whereby a vertical wipe friction occurs between the plug contact and the side contact beams. After repeated insertion of the plug contact, the outside conductive material, such as gold, coated on the plug contact and the side contact beams of the receptacle contact may fall off, thereby adversely affecting the electrical connection between the plug contact and the receptacle contact. On the other hand, the side contact beams are easy to rotate with the deformation of the central contact beam, thereby increasing the difficulty of ensuring a reliable engagement between the plug contact and the receptacle contact.

Hence, an improved electrical contact for a cable assembly is required to overcome the disadvantages of the related art.

SUMMARY OF THE INVENTION

Accordingly, an object of the present invention is to provide a cable assembly having improved electrical contacts for ensuring a reliable connection with a complementary contact.

In order to achieve the object set forth, a cable assembly in accordance with the present invention comprises an insulating housing defining a plurality of cavities, a plurality of contacts received in corresponding cavities of the housing and a plurality of cables terminated to the corresponding contacts. Each contact comprises an intermediate portion fixing the contact in the housing, a central contact beam extending upwardly from a front end of the intermediate portion, a pair of side contact beams extending upwardly from two opposite sides of the intermediate portion and a tail portion extending from a rear end of the intermediate portion. The side contact beams comprise a pair of vertical arms located at opposite sides of the central contact beam and a pair of resilient side arms extending rearwardly from the vertical arms. The side arms have connecting portions extending toward each other.

Other objects, advantages and novel features of the invention will become more apparent from the following detailed description when taken in conjunction with the accompanying drawings.

DETAILED DESCRIPTION OF THE PREFERRED EMBODIMENT

Figure 1:
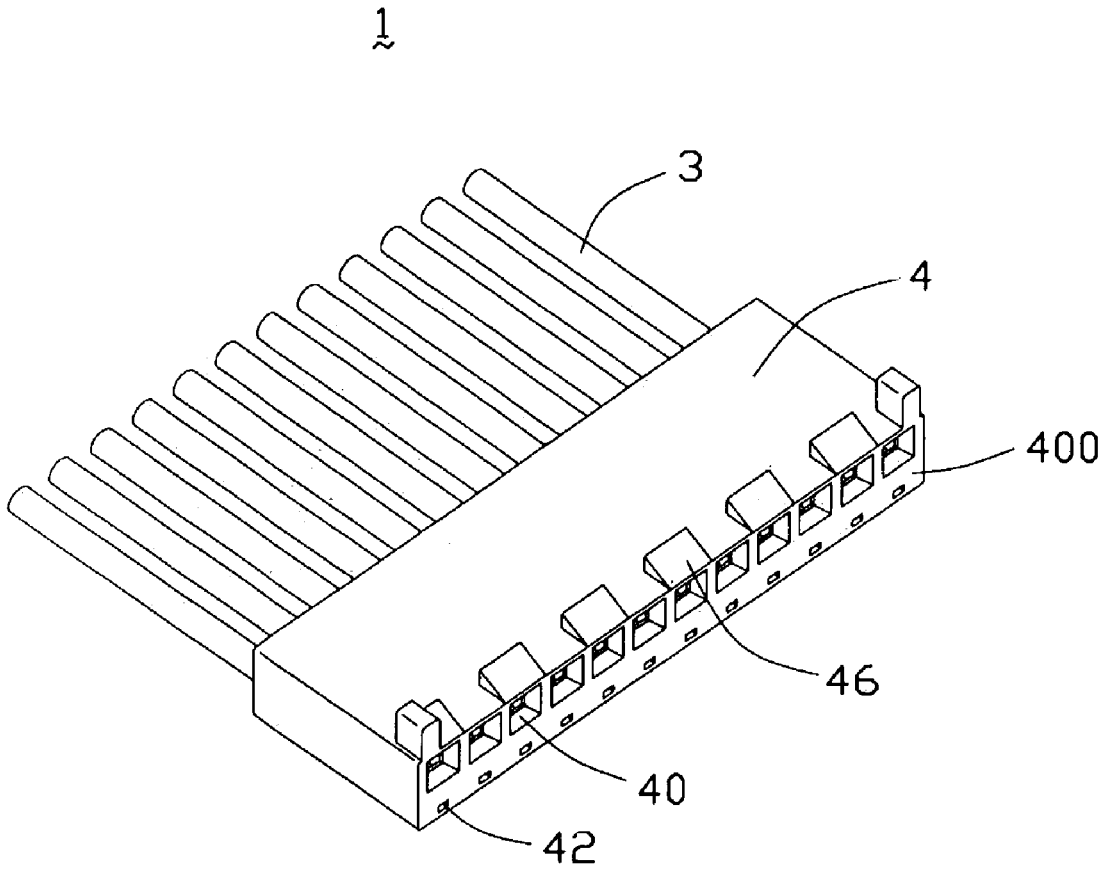
FIG. 1 is an assembled perspective view of a cable assembly in accordance with the present invention.
Figure 2:
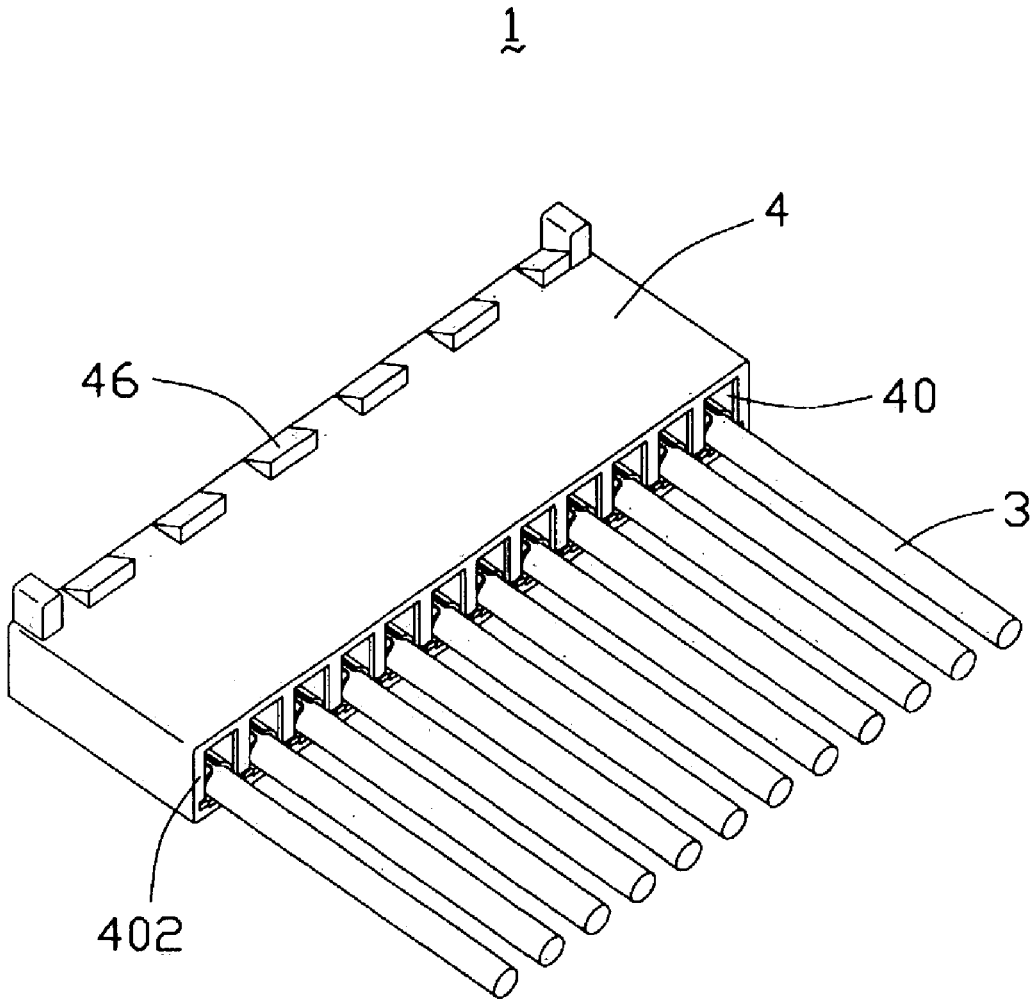
FIG. 2 is a view similar to FIG. 1 but taken from a different perspective.
Figure 3:
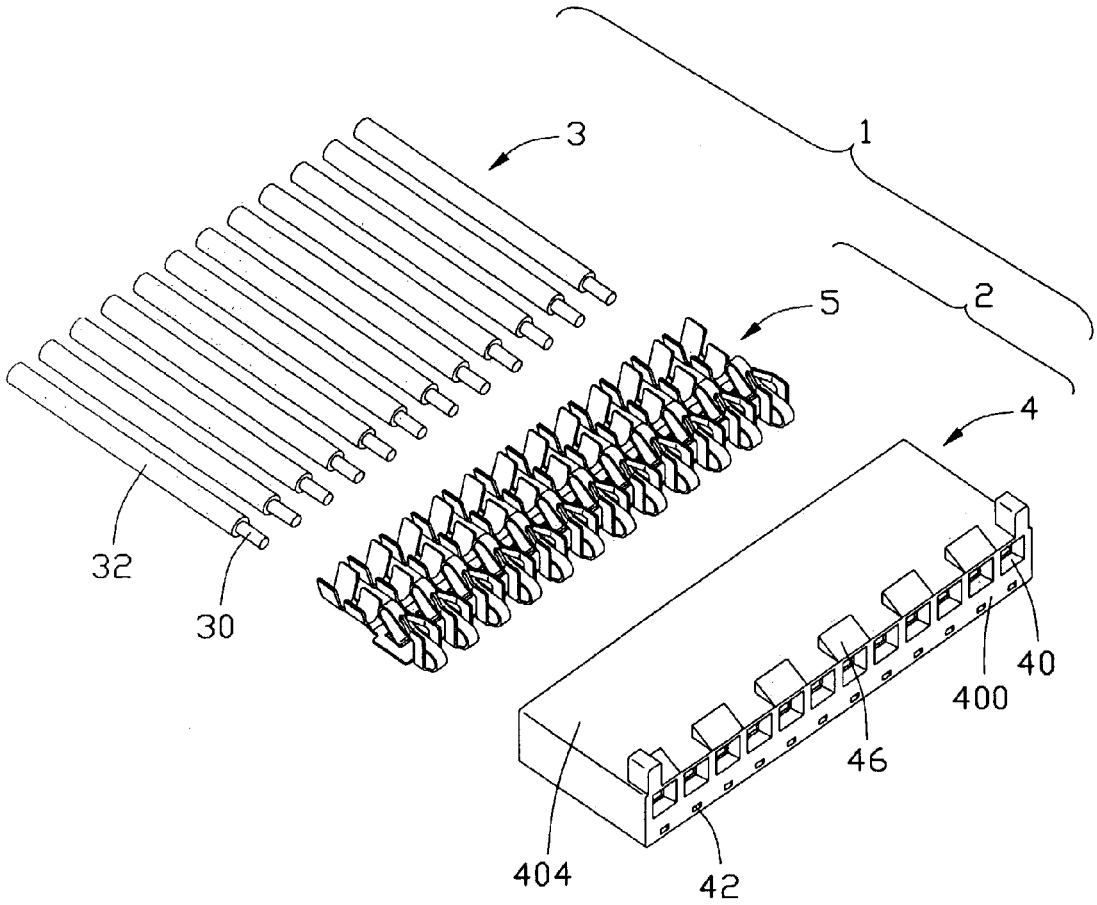
FIG. 3 is an exploded view of the cable assembly shown in FIG. 1.
Figure 4:
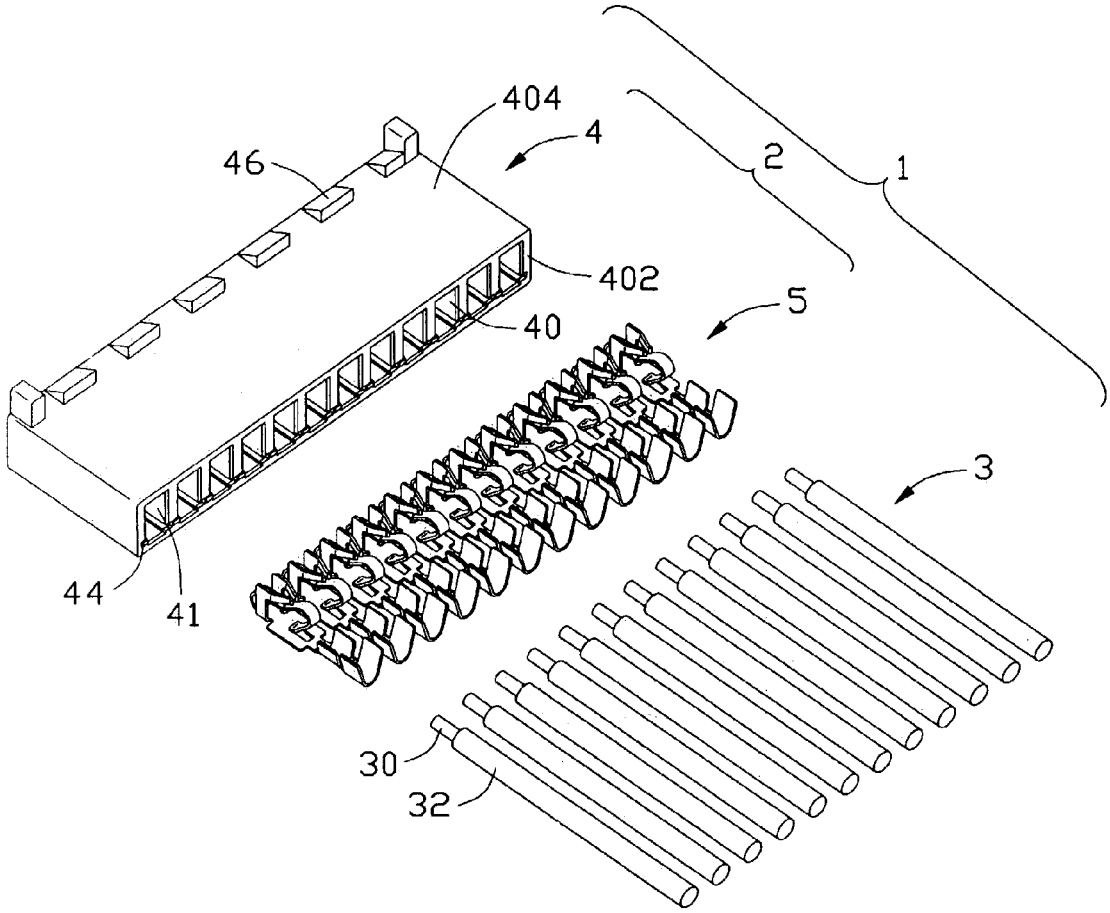
FIG. 4 is an exploded view of the cable assembly shown in FIG. 2.

Reference will now be made in detail to the preferred embodiment of the present invention.

Referring to FIGS. 1–4, a cable assembly 1 in accordance with the present invention comprises a receptacle connector 2 and a plurality of cables 3 electrically connecting with the receptacle connector 2. Each cable 3 includes an inner conductive core 30 and an outer insulator 32 surrounding the inner conductive core 30. The conductive core 30 is exposed outside at one end of the cable 3.

Figure 10:
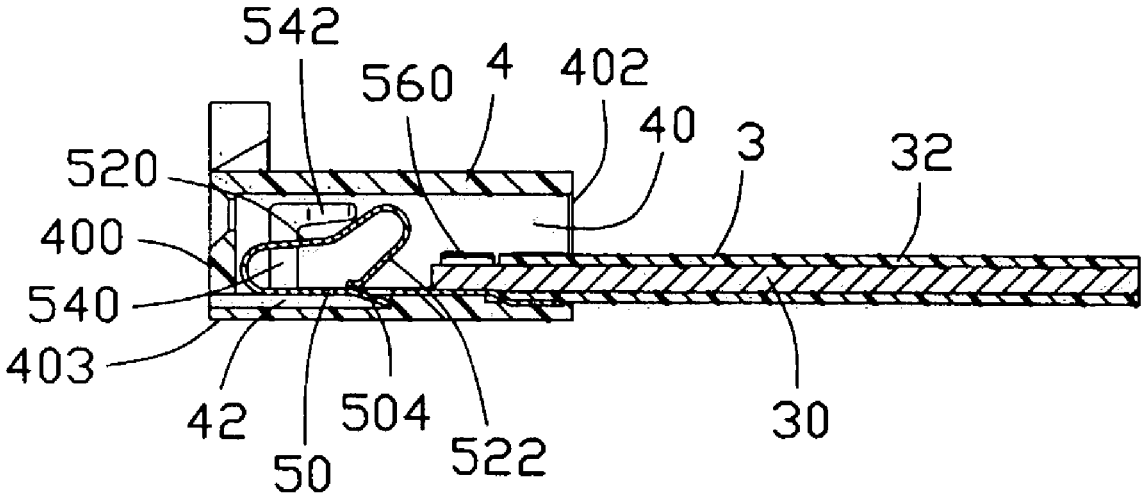
Figure 11:
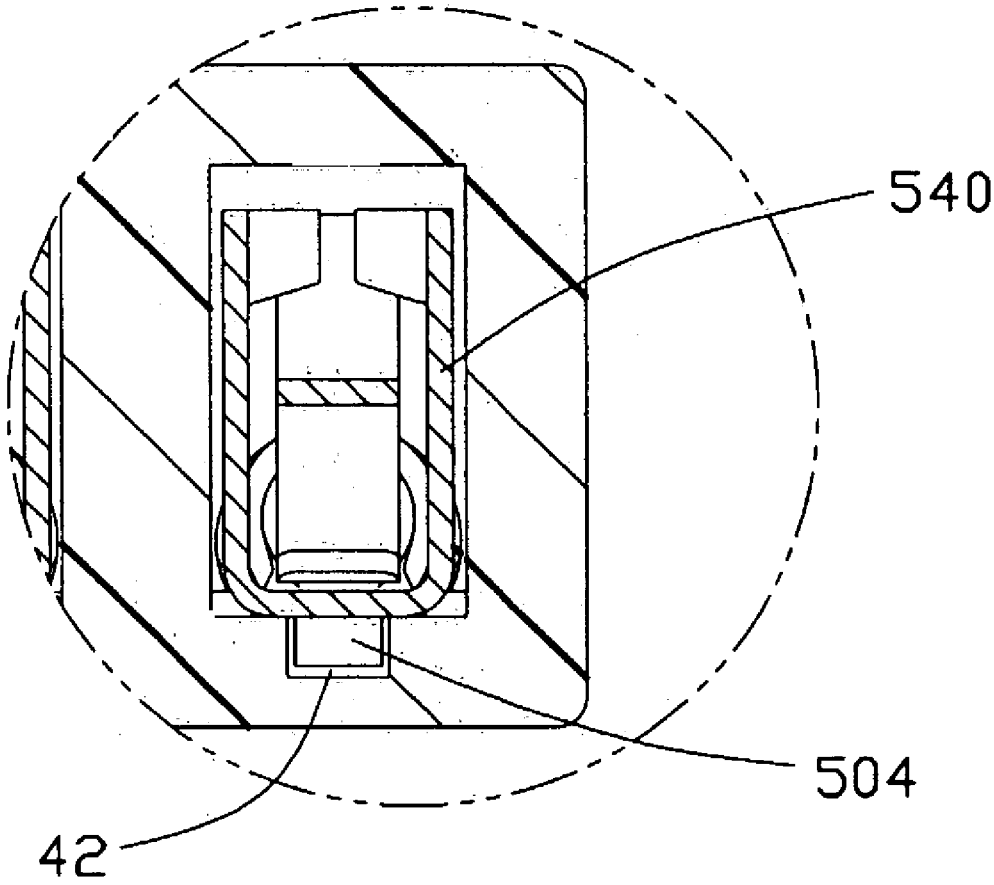
FIG. 11 is an enlarged view of a circled portion of FIG. 8 indicated by reference number 11 thereof.
Figure 12:
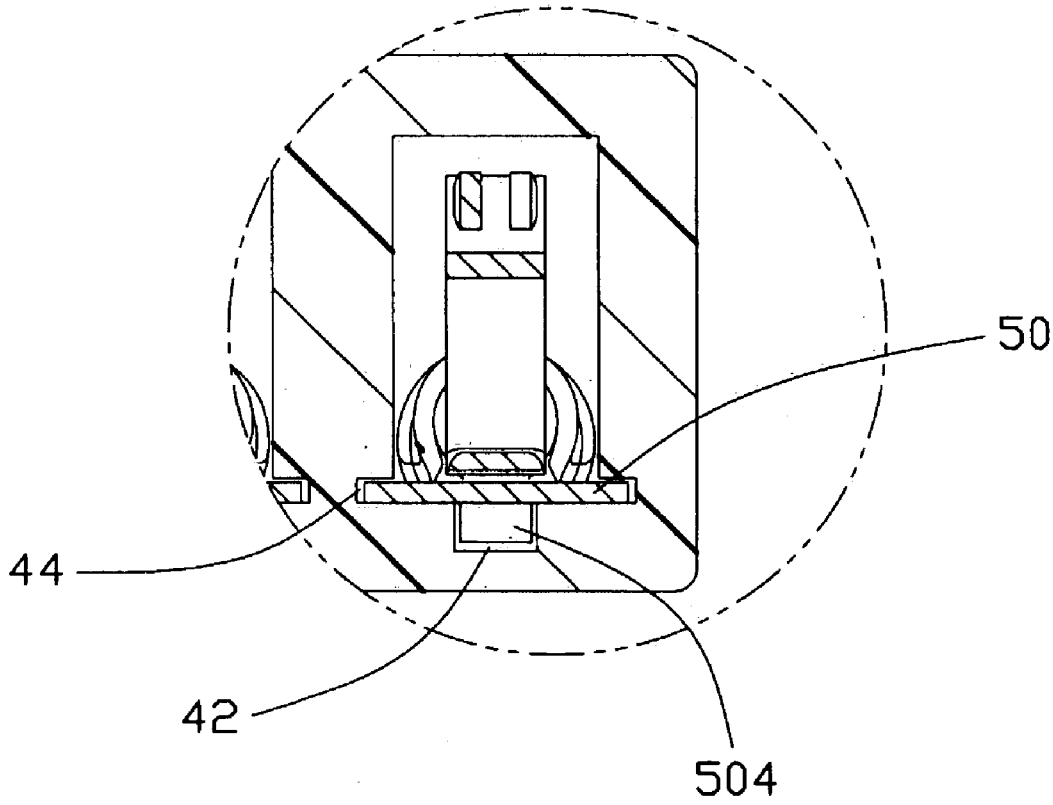
FIG. 12 is an enlarged view of a circled portion of FIG. 9 indicated by reference number 12 thereof.

The receptacle connector 2 includes a rectangular insulating housing 4 and a plurality of contacts 5 received in the housing 4. The housing 4 has a front face 400 and an opposite rear face 402. The housing 4 defines a plurality of cavities 40 extending through the front face 400 and the opposite rear face 402 along a lateral direction thereof and a corresponding number of slots 42 extending through the front face 400 while not extending through a bottom 403 (FIG. 10) of the housing. The slots 42 communicate with corresponding cavities 40. Each cavity 40 is further recessed outwardly from opposite inner sides 41 thereof to form a pair of slits 44. A plurality of latching bosses 46 is formed on a top 404 of the housing 4 adapted to be received in a corresponding latching slot of a complementary connector (not shown).

Figure 5:
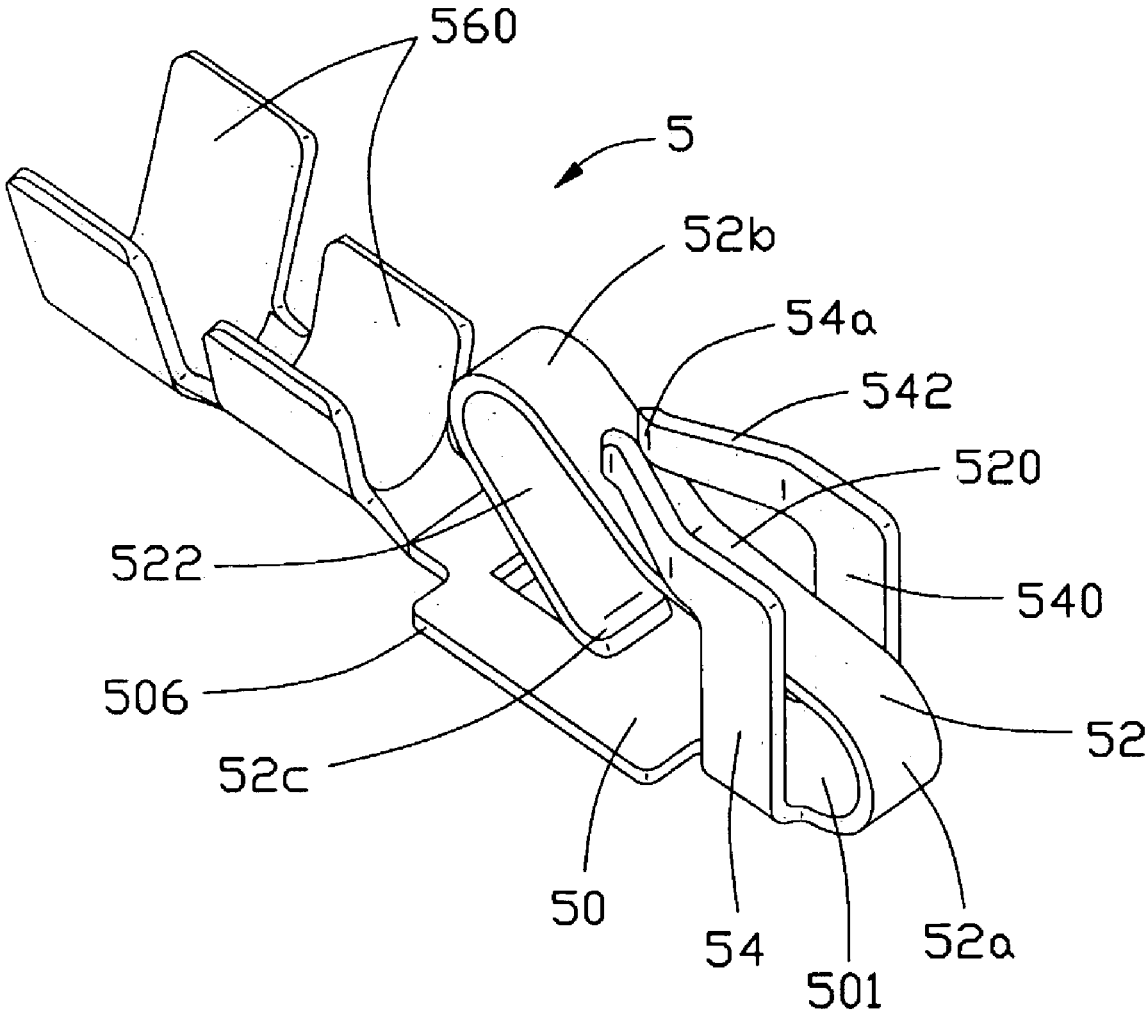
FIG. 5 is an enlarged perspective view of an electrical contact used in the cable assembly.
Figure 6:
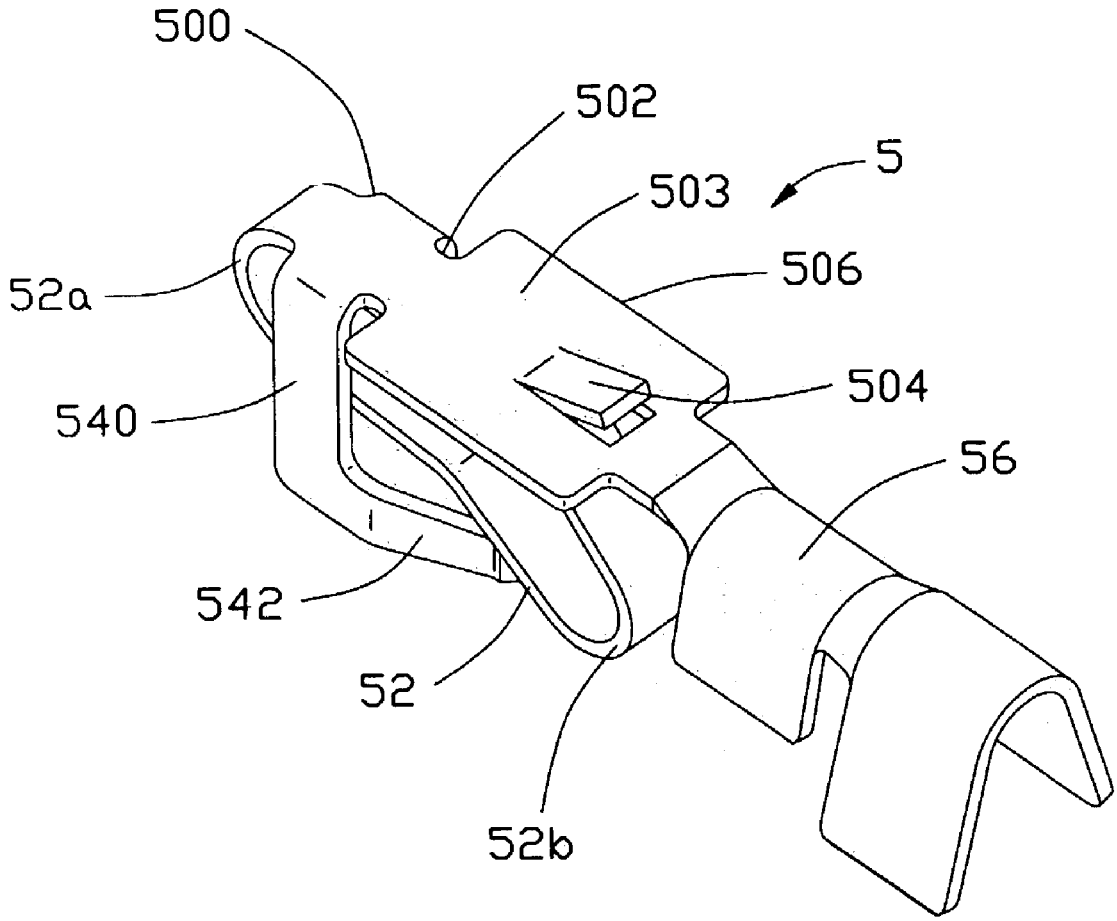
FIG. 6 is a view similar to FIG. 5 but taken from a different perspective.
Figure 7:
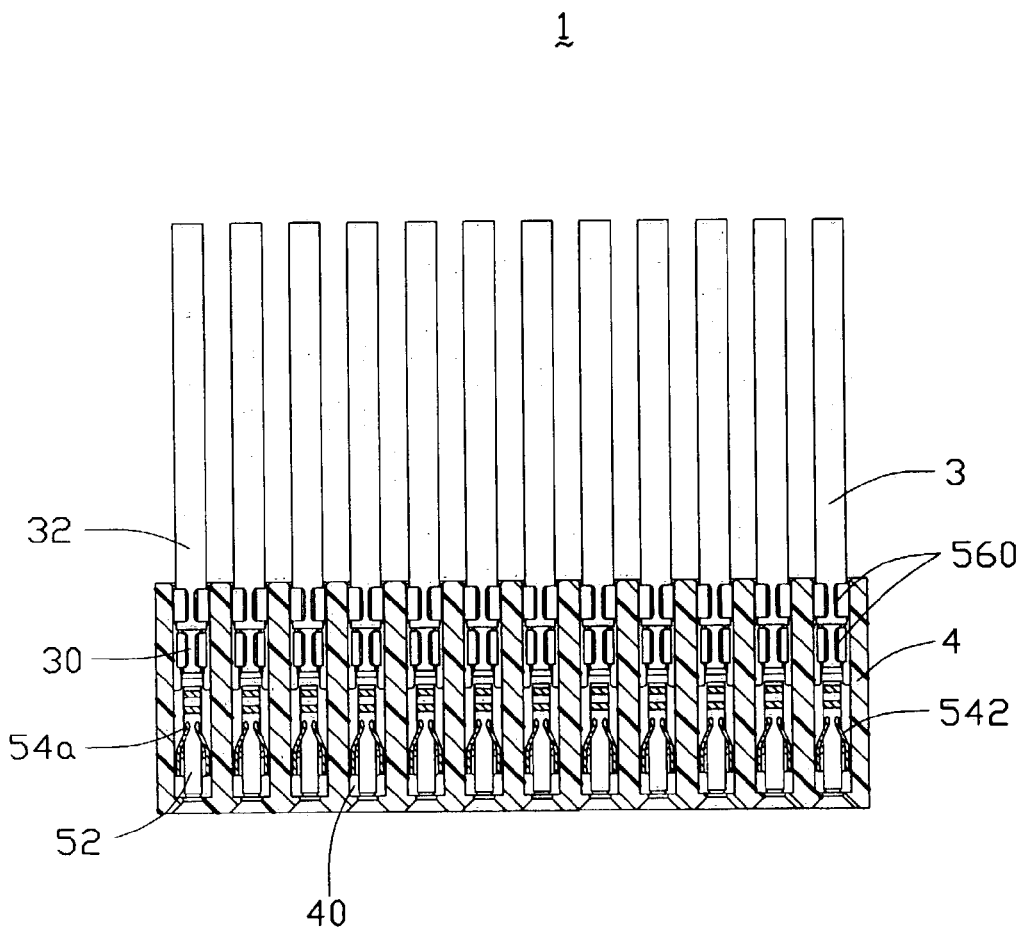
FIGS. 7–10 are cross-sectional views taken from different sections of the cable assembly shown in FIG. 1.
Figure 8:
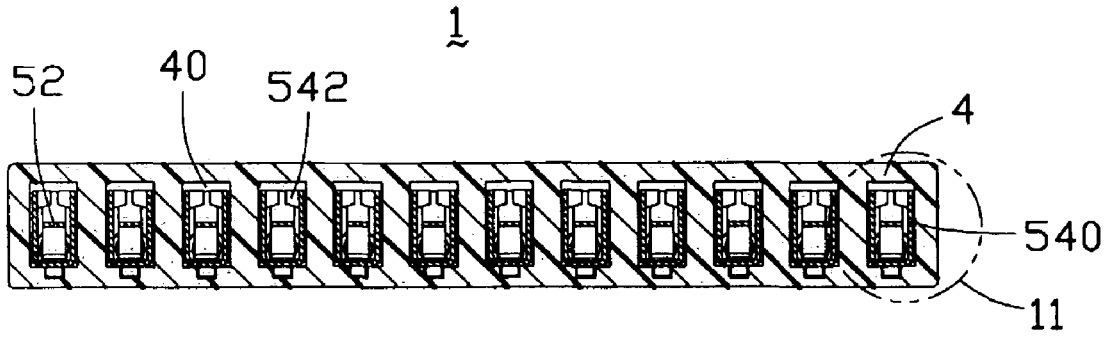
Figure 9:
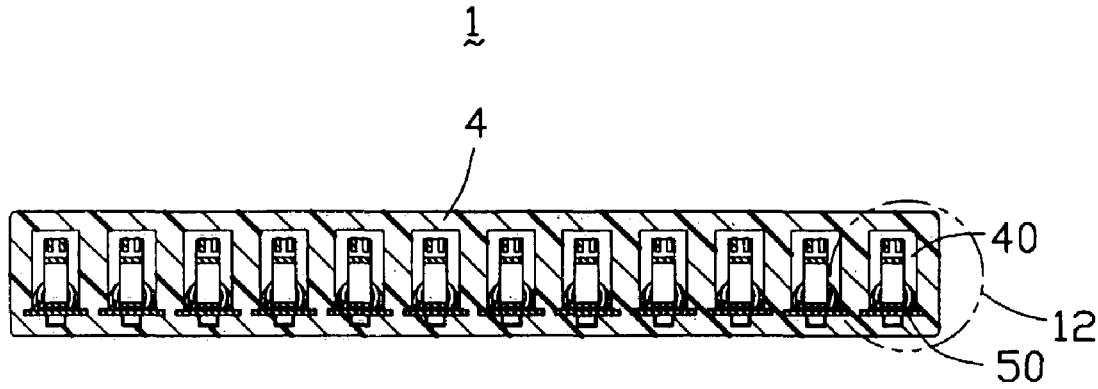

Each one of the contacts 5 is identical in structure and an exemplary one thereof is shown in FIGS. 5 and 6. Each contact 5 is formed from a conductive material and includes a planar intermediate portion 50 having a front narrow section 501 and a rear wide section 503, a central contact beam 52 extending integrally from a front end 500 of the narrow section 501, a pair of side contact beams 54 extending integrally upwardly from two opposite sides 502 of the narrow section 501 adjacent to the front end 500 and a tail portion 56 extending rearwardly from a rear end of the wide section 503 to electrically connect with a corresponding cable 3. The intermediate portion 50 has a tab 504 extending downwardly and rearwardly from the wide section 503.

The central contact beam 52 includes a first spring arm 520 extending upwardly and rearwardly from the front end 500 and a second spring arm 522 extending downwardly and forwardly from the first spring arm 520. The first spring arm 520 has a first curved portion 52*a* connecting with the front end 500 of the intermediate portion 50 and a second curved portion 52*b* connecting with the second spring arm 522. The second curved portion 52*b* is higher than the first curved portion 52*a*. The central contact beam 52 deforms downwardly about the first curved portion 52*a* to achieve an electrical contact between the second curved portion 52*b* and a complementary contact of the complementary connector. The second spring arm 522 has a free end 52*c* for abutting against the intermediate portion 50 to prevent an undue deformation of the central contact beam 52 during the insertion of the complementary contact.

The side contact beams 54 include a pair of vertical arms 540 and a pair of resilient side arms 542 extending rearwardly from top ends of the vertical arms 540. The side arms 542 have a pair of connecting portions 54*a* projecting toward each other at free ends thereof for electrically contacting with the complementary contact.

In the preferred embodiment, the tail portion 56 has two pairs of gripping wings 560 adapted to extend and wrap around the corresponding cable 3 by means of a crimp tool (not shown).

Referring to FIGS. 7–12, each contact 5 is crimped to a corresponding cable 3 with gripping wings 560 surroundingly engaging outside surfaces of the exposed conductive core 30 and the outer insulator 32. Each contact 5 with a corresponding cable 3 electrically connecting thereto is then inserted into a corresponding cavity 40 of the housing 4 from the rear face 402. The wide section 503 of the intermediate portion 50 has opposite side edges 506 received in a corresponding pair of slits 44 to prevent the contact 5 from moving upwardly and forwardly. The slits 44 can also function as guiding slits during the insertion of the contact 5 into the cavity 40. The tab 504 of the intermediate portion 50 is received in the corresponding slot 42 of the housing 4 for preventing the contact 5 from moving rearwardly. The cable assembly 1 of the present invention is thus formed.

When the cable assembly 1 mates with the complementary connector, the complementary contact simultaneously contacts with the second curved portion 52*b* the connecting portions 54*a* of a corresponding contact 5 to achieve multiple contacting points therebetween. It is noted that the side contact beams 54 do not move or rotate with the deformation of the central contact beam 52 during the insertion of the complementary contact since the side contact beams 54 integrally extend from the intermediate portion 50. Thus, a reliable engagement is ensured between the contact 5 and the complementary contact.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated broad general meaning of the terms in which the appended claims are expressed.

What is claimed is:

1. A cable assembly comprising:

an insulating housing defining a plurality of cavities;

a plurality of contacts received in corresponding cavities of the housing, each contact comprising an intermediate portion, a central contact beam extending from one end of the intermediate portion and being deflectable relative to the intermediate portion along a first direction, a pair of side contact beams extending from two opposite sides of the intermediate portion and being deflectable relative to the intermediate portion along a second direction different from the first direction and a tail portion extending from an opposite end of the intermediate portion; and a plurality of cables terminated to the tail portions of corresponding contacts, wherein the central contact beam comprises a first spring arm extending upwardly and rearwardly from the intermediate portion and a second spring arm extending forwardly and downwardly from the first spring arm and having a free end for abutting against the intermediate portion, wherein the first spring arm has a first curved portion connecting with the one end of the intermediate portion and a second curved portion connecting with the second spring arm for contacting with a complementary contact, wherein the side contact beams are located between the first and the second curved portions of the central contact beam along a longitudinal direction of the contact, wherein the side contact beams comprise a pair of vertical arms located at opposite sides of the first spring arm and a pair of resilient side arms extending rearwardly from the vertical arms and having connecting portions extending toward each other, and wherein the second curved portion of the first spring arm extends rearwardly beyond the connecting portions of the resilient side arms.

2. The cable assembly as claimed in claim 1, wherein the housing is formed with a plurality of latching bosses on a top thereof for being received in a corresponding latching slot of a complementary connector.

3. A cable assembly comprising:

an insulating housing defining a plurality of cavities;

a plurality of contacts received in corresponding cavities of the housing, each contact comprising an intermediate portion, a central contact beam extending from one end of the intermediate portion and being deflectable relative to the intermediate portion along a first direction, a pair of side contact beams extending from two opposite sides of the intermediate portion and being deflectable relative to the intermediate portion along a second direction different from the first direction and a tail portion extending from an opposite end of the intermediate portion; and a plurality of cables terminated to the tail portions of corresponding contacts, wherein the side contact beams comprise a pair of vertical arms located at opposite sides of the central contact beam and a pair of resilient side a=ms extending rearwardly from the vertical arms and having connecting portions extending toward each other, wherein the housing defines a pair of slits communicating with the cavity and receiving opposite side edges of the intermediate portion therein, and wherein the housing defines a slot extending through a front face while not extending through a bottom face thereof, the slot communicating with the cavity, and the intermediate portion of the contact comprises a tab received in the slot.

4. The cable assembly as claimed in claim 3, wherein the cable includes an inner conductive core and an outer insulator surrounding the inner conductive core, the cable having an exposed conductive core at one end thereof, and wherein the tail portion comprises two pairs of gripping wings respectively crimped onto the exposed conductive core and the insulator.

* * * * *